United States Patent [19]

Goldhammer et al.

[11] Patent Number: 4,881,692

[45] Date of Patent: Nov. 21, 1989

[54] STRIPPING MEANS FOR SHREDDING MACHINE OR THE LIKE

[75] Inventors: Albert Goldhammer, Ueberlingen; Hans Schleicher, Markdorf; Hartmut Stangenberg, Owingen; Rolf Gasteier, Markdorf, all of Fed. Rep. of Germany

[73] Assignee: Feinwerktechnik Schleicher & Co., Fed. Rep. of Germany

[21] Appl. No.: 163,737

[22] Filed: Mar. 3, 1988

[30] Foreign Application Priority Data

Mar. 4, 1987 [DE] Fed. Rep. of Germany ..... 3706862

[51] Int. Cl.[4] ..... B02C 18/22

[52] U.S. Cl. ..... 241/167; 241/236

[58] Field of Search ..... 241/236, 235, 166, 167

[56] References Cited

FOREIGN PATENT DOCUMENTS 3121666 12/1982 Fed. Rep. of Germany .

2098503 11/1982 United Kingdom ..... 241/236

*Primary Examiner*—Mark Rosenbaum

*Attorney, Agent, or Firm*—Steele, Gould & Fried

[57] ABSTRACT

In a stripping means for shredding machines or the like with spaced interleaved cutting disks (5), primary strippers (8, 9 or 10, 11) closest to the cutting zone engage in a circumferential zone of the associated cutting roller (4), but only in every other annular slot (6). The intermediate annular slot (6) is occupied by strippers (9, 8 or 11, 10) at another circumferential zone of cutting roller (4). An advancing load of comminuted material does not simultaneously strike all the primary strippers over the entire roller length for stripping. Instead, the load strikes the strippers in time succession. The primary strippers form guide elements through which adjacent material flows (28, 29) of the comminuted material are spaced and then can optionally be brought together again for mixing purposes. As a result it is much more difficult to re-associate parts of the material flows or the particles forming the flows in attempting to recover the position of the comminuted parts in the non-comminuted original.

32 Claims, 1 Drawing Sheet

STRIPPING MEANS FOR SHREDDING MACHINE OR THE LIKE

BACKGROUND OF THE INVENTION

1. Field of the Invention

The invention relates to a stripping means for removing material from between the cutting rollers of shredding machines or the like. In particular, the invention relates to a machine with strippers engaged in a slot between spaced disks of a cutting roller.

2. Prior Art

Such stripping means are described, or example, in DE-OS No. 31 12 666. When moving with the cutting rollers, materials to be stripped encounter the individual strippers simultaneously over the entire roller length. During the conventional forward running of the rollers the materials simultaneously arrive at the primary strippers, located on the undersides of the cutting rollers immediately adjacent to the cutting zone or the roller gap, said primary strippers being arranged over the entire length of the cutting rollers in a straight linear row, and each annular slot between successive disks being occupied by a stripper.

The known stripping means achieves satisfactory results for normal operation, but in certain cases, particularly when the shredding machine undergoes high loading and has a relatively small capacity motor, overloading can occur in sudden bursts. This happens because over the entire length of the machine the cutting rollers are simultaneously decelerated by material arriving at the same time at the primary strippers for each slot.

In the main working rotation direction of the cutting rollers further strippers can be positioned behind the primary strippers. In the known construction the further strippers are also juxtaposed in a continuous row over the length of their cutting roller. During normal forward operation of the cutting rollers the further strippers act in the main working direction as secondary strippers for stripping material which has not been stripped by the primary strippers. When reversing, i.e., for oppositely-directed operation of the cutting rollers, said secondary strippers act as primary strippers, while the primary strippers then act as secondary strippers. Thus, which strippers are primary and which are secondary is a function of the two possible rotation directions of the cutting roller.

Known stripping means have been found to consume up to 30% or more of the drive capacity available for moving the cutting rollers. Although a lower drive capacity might be sufficient for a given actual comminution process, a relatively higher drive capacity must be installed in order to ensure reliable operation. This increases the dimensions of the apparatus and increases costs, but still does not avoid the need for relatively frequent corrective operations, during which the cutting rollers are briefly driven in opposite directions for self-cleaning purposes. This maturally leads to a reduction in the working power of the shredding machine per unit of time.

SUMMARY OF THE INVENTION

An object of the present invention, in connection with a stripping means of the aforementioned type, is to avoid these disadvantages by arranging the apparatus such that all the strippers are not simultaneously subjected to the variations in material loading which occur in the comminution process, and instead the strippers are applied to the load in a predetermined time sequence.

This object is achieved in the case of a stripping means of the aforementioned type by displacing adjacent strippers along the length of the cutting roller, circumferentially around the roller. According to the invention primary strippers are provided at different circumferential spacings from the cutting zone. Therefore the material successively, and not simultaneously, strikes the primary strippers. As a result there is a much lower instantaneous loading of the cutting roller or its drive, as well as the stripping means. Unlike the burst-like instantaneous braking or blocking of the known cutting roller, there is a much gentler braking or deceleration as the load is spread over time. This considerably reduces the forces acting on all the important parts of the shredding machine. The construction according to the invention can be provided both for operation in the main working rotation direction and instead of, or in addition thereto, for operation in the reverse rotation direction.

It is conceivable to stagger the strippers, for example such that they are arranged in displaced manner with respect to one another along at least one relatively steep helical pitch line. The strippers can be arranged in a displacement diagram which is symmetrical with respect to the center of the length of the cutting roller. Accordingly a maximum of one or two of the strippers are reached at the same time by a load of the material to be comminuted or which has been comminuted, which leads to a particularly low or gentle loading. A particularly simple construction is obtained, however, if adjacent primary strippers are substantially alternately reciprocally displaced. In that arrangement, two groups of primary strippers are obtained for the particular working rotation direction of the cutting roller, and all the primary strippers of each group can be jointly mounted.

A particularly advantageous further development is obtained if the stripping means are placed to leave window-like passage gaps between adjacent strippers in the roller longitudinal direction. The gaps are located in the vicinity of at least one annular slot not provided with a stripper in the same circumferential zone. Therefore, materials can rotate at least one extra time around the cutting roller. The delayed materials again pass into the cutting zone, where they again undergo a comminution process. These materials then pass later than the parts of the comminuted material from which they were separated, into the collection container associated with the shredding machine. This makes it even more difficult to find and re-associate the originally-associated particles, as necessary for reconstructing the comminuted material, and further increases security.

The invention is suitable for strip-like strippers, e.g., in the form of sheet metal tongues, and is suitable in particular for solid stripping bodies. The bodies extend around the slot bottom of the particular annular slot over at least part of its circumference and have two substantially oppositely directed stripping edges for the two possible rotational directions of the cutting roller. The invention is also suitable for cutting tools which are so-called strip cutters, namely those that merely separate the material to be comminuted into spaghetti-like strips. The invention is particularly suitable for so-called particle cutters, in which the material to be comminuted is subdivided into discrete small particles, e.g. through the formation and transverse separation or cutting of spaghetti-like strips. This is generally achieved in that the cutting disks of the cutting rollers are circumferentially radially toothed or are provided with slot-like tearing and breaking slots. For example, the disks can be grooved rollers.

A particularly advantageous further development of a stripping means is achieved in that guide elements are provided to separate the initially juxtaposed, strip-like material parts formed at the starting region of the cutting tool, and optionally to also separate juxtaposed parts after transverse separation into successive individual particles. These parts flow along paths corresponding to the annular slots of the cutting roller. The guide elements are reciprocally displaced so that these initially juxtaposed material flows leave the cutting tool at a more or less large spacing from their respective counterparts and therefore arrive in correspondingly separated manner at the collecting container or the like associated with the shredding machine. This also makes it much more difficult to reconstruct the comminuted original because one cannot find in the same area the parts which were together in the intact material.

According to the invention, the guide elements can be formed in an extremely simple manner exclusively or at least in part by strippers, e.g., the primary strippers. The separation of the juxtaposed material flows does not have to take place exclusively through the guide elements, but can also be achieved in simple manner in that adjacent parts of the material flows are stripped at different circumferential zones of the cutting roller by the particular guide element and are then led away. Separation of the juxtaposed parts partly occurs because the displaced guide elements are horizontally displaced. The separated material flows leave their respective guide element in substantially vertically downward direction due to gravity, falling in separate flows.

In the downstream movement direction of the material flows following the guide elements, it is possible to provide further guide members, e.g., in the form of guide plates. The guide plates bring the separated material flows back together again or optionally even intermix them to disturb them further. Those parts of the material flow which are carried further from the cutting zone, leaving the cutting tool through the associated guide element, have longer movement path than the material flows leaving close to the cutting zone. Accordingly there is a relative displacement in the longitudinal direction of the material flows downstream of the cutting tool, as compared with the comminuted original. As a result the separated the separated parts are mixed up, making reconstruction much more difficult.

BRIEF DESCRIPTION OF THE DRAWINGS

The foregoing features, and further features of preferred further developments of the invention, can be gathered from the description and drawings, and individual features can be realized in any embodiment of the invention and in other fields either individually or in the form of subcombinations. Embodiments of the invention are described in greater detail hereinafter relative to the drawings, wherein.

DETAILED DESCRIPTION OF THE PREFERRED EMBODIMENTS

Figure 1:
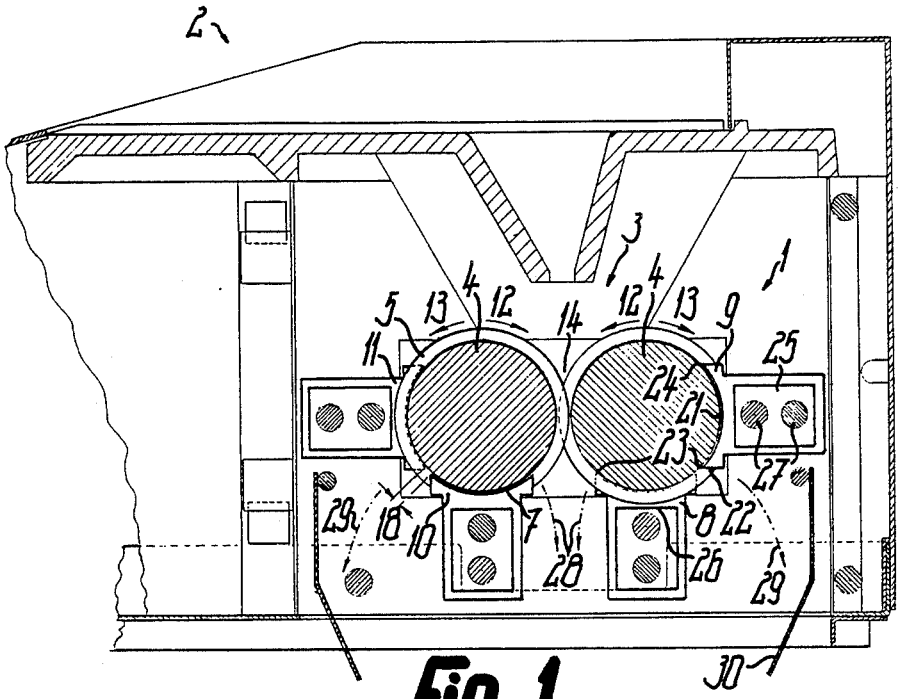
FIG. 1 is a detail of a shredding machine provided with a stripping means according to the invention, shown in a vertical section.

As shown in FIG. 1, a shredding machine 2 is provided for receiving stripping means 1 according to the invention. Machine 2 has a flat casing provided with a tearing or cutting tool 3 with substantially identical cutting rollers 4 extending approximately across the entire width of the casing between bearing brackets. The outer circumference of each rollers 4 has ring disk-like cutting disks 5 uniformly distributed over approximately the entire length of the roller. Between disks 5 are interposed annular slots 6, with an only slightly greater width than the cutting disks. The cutting disks 5 of each cutting roller 4 engage in the annular slots 6 of the facing cutting roller 4 such that the cutting disks 5 extend almost to the associated bottoms 7 of the slots 6. The cutting disks of the cutting rollers 4 meshing in this way are circumferentially provided with profiling effects, e.g., slots cutting and tearing teeth, etc., for producing a particle cut by means of such profiling effects. The slots or teeth appropriately do not extend to the slot bottom 7 and for reasons or simplicity are not shown in detail in FIGS. 1 to 3. The slots, e.g., can be defined in rectangular manner and can in the circumferential direction have a smaller extension than the intermediate members left behind. The teeth are roughly equal-sided pointed, saw tooth-like forms with sloped facets leading in the working direction or truncated on the tooth head. Above the roller gap between the cutting rollers 4 issues a funnel-shaped, constricted shaft defined by the casing cover, for introducing material to be processed. The shaft extends over the working width of the cutting rollers 4 and is provided for introducing the material to be comminuted, e.g., one or more layers of paper.

For each cutting roller 5, the stripping means 1 has a number of strippers 8, 9 or 10, 11 substantially precisely corresponding to the number of annular slots 6, so that there is a single stripper engaging in each annular slot 6. All the strippers are reversible and interchangeable, having plates and approximately T-shaped stripping bodies. The strippers, for example, are sheet metal stamped parts, appropriately having the same thickness as the cutting disks 5 and therefore engaging with the associated annular slot 6 with a very small clearance of only a few tenths of a millimeter. The strippers 9 to 11 are fixed relative to the casing. In the main working rotation direction according to arrow 12, the cutting rollers 4 rotate with respect to the fixed strippers 9 to 11 so that the circumferential surfaces of the rollers 4 move downwards in the vicinity of cutting zone 14. The rollers rotate in the opposite direction according to arrow 13 in the reversing direction.

Figure 2:
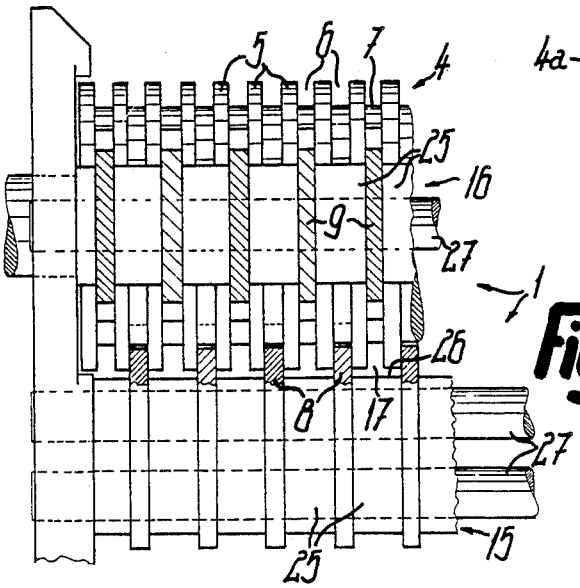
FIG. 2 is a detail of the shredding machine according to FIG. 1, as seen from the right and on a larger scale.

Strippers 8, 9 or 10, 11 of the particular cutting roller 4 are in each case arranged in two separate groups 15, 16 of separately mounted strippers. The groups alternate such that a stripper 8 or 9 of one group 15 or 16 engages in an annular slot 6 and a stripper 9 or 8 of the other group 16 or 15 engages in an adjacent annular slot 6. In each case the particular annular slot 6 is free of strippers over its remaining circumference and at least up to the cutting zone. Strippers 8, 9 or 10, 11 of the two groups 15, 16 of each cutting roller 4 are reciprocally displaced around the associated roller axis relative to one another by an angle of at least 30° to 60° and preferably at least approximately 90°, so that the strippers act on circumferential areas of the particular cutting roller 4 which are spaced at a distance along an arc. Adjacent strippers 8, 9 or 10, 11 of the particular group 15 or 16 have in each case an inside spacing with respect to one another corresponding to the width of a specific number of annular slots 6, plus the thickness of a number of cutting disks 5, increased by one compared with said number. In the represented embodiment this spacing is the same as the width of an annular slot, plus the thickness of two cutting disks 5. The central spacing between adjacent strippers consequently corresponds to the disk-to-disk pitch spacing or to an integral multiple of the longitudinal pitch or division of the particular cutting roller. Appropriately, all the spacings are identical, but the spacings can also alternate or be made similar. In the area of each group 15, 16 of strippers, there is a gap between adjacent strippers, the gap extending over at least one annular slot 6 and the flanking cutting disks 5. As shown in FIG. 2, passage gap 17 is thus formed for the material, substantially completely limited over its circumference and which is laterally bounded by the adjacent strippers 8 or optionally the flanking cutting disks 5, the associated slot bottom 6 and the support arrangement for the strippers. The gap 17 as shown in the view according to FIG. 2 is, for example, approximately T-shaped. As a result of the curved surfaces of the cutting roller and the facing boundary surface of the support arrangement, the passage gap 17 tapers in funnel-shaped manner from the two inlet or outlet sides towards its center. The particular passage gap 17 is then followed in the circumferential direction by the associated stripper of the other group, so that the passage gaps, with respect to the annular slots 6, alternate corresponding to the strippers.

In order that the material has completely left the strippers 8 of the upstream group before reaching the next group of strippers 9 in the working rotation direction, there is an adequately large inside distance along the arc or arc spacing 18 between the strippers 8, 9 or 10, 11 of the two groups 15, 16. The spacing 18 can be much smaller than the circumferential extension of a stripper and can, e.g., be between a few radians and a maximum slightly more that 45°.

Each of the approximately T-shaped strippers 9 to 11, has a central or symmetry plane substantially located in an axial plane of the associated cutting roller 4. Each T-shaped stripper forms with the transverse T-web at the top of its T-shape a concave inner face 21, curved around the associated roller axis. Inner face 21 is located at a relatively small spacing with respect to the associated slot bottom 7 and has approximately the same curvature as the slot bottom. This inner face 21 passes into end faces 22, which are parallel to one another, approximately parallel to said axial plane. As the ends of the T-transverse web or member, inner face 21 forms with end faces 22 on either side of the stripper in each case one stripping edge 23 or 24, which is bounded in acute-angled, like a paring edge. The stripping edges 23 directed counter to the main working rotation direction (shown by arrow 12) are effective during the normal operation of cutting tool 3. The oppositely-directed cutting edges 24 are mainly effective during reverse operation.

The mounting or securing of the strippers is accomplished such that they are tiltable to a limited extend about an axis parallel to the associated roller axis and spaced from the roller circumference. Therefore, the particular effective stripping edge 23 or 24 under the loads which occur is drawn in self-adjusting manner against the associated slot bottom 7 and consequently at least approximately acts to scrape the slot bottom. The arc spacing of the two stripping edges 23, 24 of each stripper 9 to 11 is appropriately between approximately 30° and 120°, preferably approximately 90° or slightly smaller.

Strippers 8, 9 or 10, 11 of each group 15 or 16 are mounted in packet-like manner in closed constructional units, in each case on two cylindrical supporting rods 27. The ends of supporting rods 27 are fixed on the casing or on the associated bearing brackets of cutting rollers 4. The two supporting rods 27 are located in the associated axial plane of cutting roller 4, radial to the same and in successive manner. Supporting rods 27 traverse bores in the T-foot portions of the strippers, which can have limited bearing play with respect to the supporting rods 27 for said limited tilting capability. All the groups of strippers can be formed by identical, corresponding constructional units and are therefore interchangeable.

Between adjacent strippers, rectangular, plate-like spacers 25 are arranged with corresponding bores on supporting rods 27. The external dimensions of said spacers 25 are slightly smaller than the corresponding external dimension of the T-foot portions of the strippers, so that on all sides the spacers are set back with respect to said outer edges. The side of each spacer 25 facing the particular cutting roller 4 forms a planar guide surface 26 as a corresponding boundary of the associated passage gap 17. The planar guide surface 26 is approximately tangential to the circumference of the associated cutting roller 4. The material passing through the passage gap 17 is drawn along surface 26 into the passage gap 17 and then moved out again.

The stripping edges 23 of the corresponding groups 15 of strippers 8, 10 located closest to the narrowest point of cutting zone 14 have, with approximately 50°, a smaller arc spacing from said narrowest point than the stripping edges 24 of the other group 16 pointing in the opposite direction and next to said narrowest point. Therefore the first mentioned stripping edges 23 are very rapidly reached by the material after passing out of the cutting zone 14. The material is then removed from the annular slot 6 by said stripping edges 23 and between the two groups 15 of strippers 8, 10 is led substantially vertically downwards, the associated, faces 22 of said strippers 8, 10 acting as guide faces. Strippers 8, 10 have a greater spacing than the slot depth of the annular slot 6 from the median plane of the cutting zone 14 approximately at right angles to the common axial plane of cutting rollers 4, particularly roughly twice as large. Thus, the two material flows 28 led away from these stripping edges 23, as indicated by the dot-dash arrows in FIG. 1, are led downwards in spaced manner from one another.

The material flows 29 located between material flows 28 in the roller longitudinal direction are removed from the associated annular slot 6 by the stripping edges 23 of the strippers 9, 11 furthest from the cutting zone 14 in the circumferential direction. These flows 29 are consequently dropped downwards at a much further horizontal spacing from the median plane of cutting zone 14. The guide faces formed by the approximately horizontal end faces 22 of strippers 9, 10, as a result of the described construction, are located approximately in the horizontal direction or at right angles to the median plane of cutting zone 14. These end faces are at a distance from the corresponding upright guide faces 22 of the other strippers 8, 10 of the associated cutting roller 4 which distance can be approximately half the internal diameter of the annular slot 6, is appropriately larger than the same, and is preferably approximately at least ¾ of said internal diameter.

A guide body is preferably provided in the movement area of the material flows 28, 29 leaving the cutting zone 14 or the cutting rollers 4 and the guide elements formed by strippers 8 to 11. The guide body is provided for at least one of the two outer material flows 29, and may include a guide plate 30, with an inclined guide face, which appropriately faces the median plane of cutting zone 14. Guide plate 30 is struck by material flow 29 during its downward movement in such a way that flow 29 is correspondingly directed away in sloping manner. Thus, material flow 29 can be wholly or partly moved towards the central material flows 28 again, so that the particles of said material flows in part mix, at the latest on reaching a lower collecting point. A lower collecting point can in simple manner be formed by a container, flexible bag or the like, fastened to the bottom of the shredding machine or the casing, the guide plates 30 appropriately projecting beyond the underside of the casing, and being open in the vicinity of cutting tool 3.

In the embodiment according to FIGS. 1 and 2, the median planes of strippers 8, 10 of the lower groups 15 are approximately parallel to one another and parallel to the median plane of cutting zone 14, i.e., vertical in the present case. The median planes of strippers 9, 11 of the upper groups 16 are aligned with one another and are approximately in the common axial plane of cutting rollers 4, i.e., approximately horizontal in the present case. Accordingly there is an average arc spacing between the two groups of approximately 90°. As a function of the circumferential extension of the strippers, this arc spacing can also be smaller or, as illustrated by arc spacing 19 in FIG. 3, larger, for example approximately 135° or more, e.g., approximately 180°. The inside arc spacing 18*a* is approximately 45° in this embodiment. The arc angle over which the particular stripper 8*a* or 9*a* extends in the circumferential direction is designated 20 in FIG. 3. Otherwise the same numerals are used in FIG. 3 as in FIGS. 1 and 2, but are followed by the letter "a".

Figure 3:
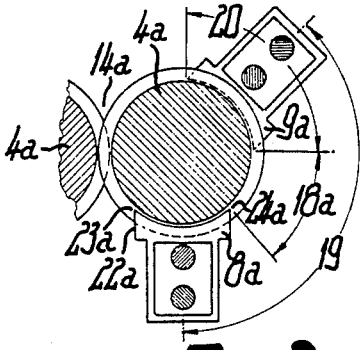
FIG. 3 shows another embodiment of a stripping means in a detail representation comparable to FIG. 1.

All the strippers 9 to 11 form in the embodiments shown in FIGS. 1 to 3 so-called primary strippers, because their stripping edges 23 or 24 during the particular rotation direction of the cutting rollers 4 are the first and only ones which are reached by the material received in the associated annular slot. Based on the working rotation direction, it is conceivable to provide behind the particular primary stripper or stripping edge a secondary stripper or stripping edge for the associated annular slot.

We claim:

1. A stripping means in combination with at least one shredding roller of a shredding machine having a shredding zone for material to be comminuted, said shredding roller having annular slots located between shredding disks and defining a longitudinal direction, a circumferential direction and rotational operating direction, said combination comprising:

a plurality of stripper members, each of said stripper members engaging in an annular slot of said shredding roller, said stripper members forming adjacent primary strippers located adjacent to one another with respect to said longitudinal direction and closest to said shredding zone with respect to said rotational operating direction, wherein at least several of said primary strippers are displaced with respect to one another in said circumferential direction of said shredding roller.

2. The combination according to claim 1, wherein said primary strippers are substantially alternately reciprocally displaced with respect to each other.

3. The combination according to claim 1, wherein at least some of said primary strippers are arranged in at least one group of primary strippers, said group being displaced with respect to further strippers in said circumferential direction, thereby providing juxtaposed primary strippers and circumferentially displaced primary strippers.

4. The combination according to claim 3, wherein the juxtaposed primary strippers of one said at least one group are located on an underside of said shredding roller and are arranged substantially symmetrical to an axial plane of said cutting roller.

5. The combination according to claim 3, wherein the primary strippers of at least one said at least one group are mounted on common supporting rods.

6. The combination according to claim 3, wherein substantially all of said primary strippers provided for one said at least one shredding roller are arranged in two groups, the primary strippers of each group being located in a row substantially parallel to said longitudinal direction of said shredding roller.

7. The combination according to claim 3, wherein primary strippers of at least one of said at least one group are located at a spacing with respect to each other, said spacing corresponding to a thickness extension of two shredding disks, plus a width extension of an annular slot of said roller.

8. The combination according to claim 7, wherein between juxtaposed primary strippers of at least one of said at least one group are provided spacers having a thickness corresponding to said spacing.

9. The combination according to claim 8, wherein said spacers extend close to outer circumferences of at least two adjacent shredding disks.

10. The combination according to claim 8, wherein said spacers of at least one of said at least one group are mounted on common supporting rods.

11. The combination according to claim 8, wherein said spacers and said primary strippers of at least one said at least one group are mounted on common supporting rods.

12. The combination according to claim 1, wherein between juxtaposed located primary strippers is provided a passage gap for the material to be comminuted, said passage gap extending at least over a slot depth extension of the annular slots provided between said juxtaposed primary strippers.

13. The combination according to claim 12, wherein said passage gap extends at least over a circumferential extension of at least one of said juxtaposed primary strippers.

14. The combination according to claim 1, wherein as seen in said longitudinal direction, the circumferentially displaced primary strippers have an inner arc spacing from one another in said circumferential direction.

15. The combination according to claim 14, wherein said inner arc spacing is substantially smaller than a circumferential extension of at least one of said circumferentially displaced primary strippers.

16. The combination according to claim 1, wherein a central arc spacing between the circumferentially displaced primary strippers corresponds to at least 90° to 135° with respect to a roller axis of said shredding roller.

17. The combination according to claim 1, wherein at least some of said primary strippers extend over an arc angle of substantially 90° with respect to a roller axis of said shredding roller.

18. The combination according to claim 1, wherein at least some of said primary strippers have at least one stripping edge.

19. The combination according to claim 1, wherein at least some of said primary strippers have two stripping edges facing oppositely, namely in a counter-rotating direction opposite to said rotational operating direction and in said rotational operating direction.

20. The combination according to claim 18, wherein at least one said at least one stripping edge of each primary stripper is bounded by an inner face curved around a slot bottom of an associated one of the annular slots and is further bounded by an end face adjoining to said inner face at an acute angle.

21. The combination according to claim 1, wherein substantially all of said primary strippers for said shredding roller are equally constructed.

22. A stripping means in combination with at least one shredding roller of a shredding machine having a shredding zone for material to be comminuted, said shredding roller having annular slots located between shredding disks and defining a longitudinal direction, a circumferential direction and rotational operating direction, said combination comprising:

a plurality of stripper members, each of said stripper members engaging in an annular slot of said shredding roller, said stripper members forming adjacent primary strippers located adjacent to one another with respect to said longitudinal direction and closest to said shredding zone with respect to said rotational operating direction, wherein guide elements are provided for guiding said comminuted material in separated material flows running off said at least one shredding roller at a circumferential distance from each other, said guide elements having guide faces constructed for leading off adjacent material flows at a circumferential spacing from one another.

23. The combination according to claim 22, wherein at least some of said guide elements are constructed as stripper members.

24. The combination according to claim 22, wherein at least some of said guide elements are provided by primary strippers.

25. The combination according to claims 1 or 22, wherein at least one said at least one shredding roller has means for separating said comminuted material transversely into particles.

26. The combination according to claim 25, wherein shredding disks of said shredding roller are toothed on a circumference.

27. The combination according to claim 22, further comprising means for mixing at least two of said separated material flows in a zone spaced from said shredding zone.

28. The combination according to claim 27, wherein said means for mixing includes at least one guide plate.

29. A stripping means in combination with at least one shredding roller of a shredding machine having a shredding zone for material to be comminuted, said shredding roller having annular slots located between shredding disks and defining a longitudinal direction, a circumferential direction and rotational operating direction, said combination comprising:

a plurality of stripper members, each of said stripper members engaging in an annular slot of said shredding roller, said stripping members forming adjacent primary strippers located adjacent to one another with respect to said longitudinal direction and closest to said shredding zone with respect to said rotational operating direction, wherein guide elements are provided for guiding said comminuted material in separated material flows running off said at least one shredding roller at a distance from each other, adjacent guide faces of said guide elements located adjacent to one another with respect to said longitudinal direction being displaced horizontally and circumferentially from one another.

30. The combination according to claim 29, wherein said adjacent guide faces are displaced with respect to one another by more than half of an internal diameter of said annular slots.

31. The combination according to claim 29, further comprising means for mixing at least two of said separate material flows in a zone spaced from said shredding zone.

32. The combination according to claim 29, further comprising means for mixing at least two of said separated material flows in a zone spaced from said shredding zone, and wherein said means for mixing includes at least one guide plate.

* * * * *

UNITED STATES PATENT AND TRADEMARK OFFICE

CERTIFICATE OF CORRECTION

PATENT NO. : 4,881,692

DATED : November 21, 1989

INVENTOR(S) : Goldhammer et al.

It is certified that error appears in the above-identified patent and that said Letters Patent is hereby corrected as shown below:

In the Claims:

Claim 4:
Column 8, line 22, insert --said axial plane being substantially parallel to a center plane of said shredding zone-- after "cutting roller".

Signed and Sealed this

Thirteenth Day of November, 1990

*Attest:*

HARRY F. MANBECK, JR.

*Attesting Officer*

*Commissioner of Patents and Trademarks*